US009782976B2

(12) United States Patent
Fujita et al.

(10) Patent No.: US 9,782,976 B2
(45) Date of Patent: Oct. 10, 2017

(54) LIQUID SUPPLY DEVICE AND DROPLET EJECTING APPARATUS

(71) Applicant: FUJI XEROX CO., LTD., Tokyo (JP)

(72) Inventors: Mamoru Fujita, Kanagawa (JP); Kazuhiko Hirokawa, Kanagawa (JP); Jun Isozaki, Kanagawa (JP); Yukari Motosugi, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/249,572

(22) Filed: Aug. 29, 2016

(65) Prior Publication Data

US 2017/0232755 A1 Aug. 17, 2017

(30) Foreign Application Priority Data

Feb. 12, 2016 (JP) ..... 2016-025208

(51) Int. Cl.
*B41J 2/175* (2006.01)

(52) U.S. Cl.
CPC ..... *B41J 2/17566* (2013.01); *B41J 2/175* (2013.01)

(58) Field of Classification Search
CPC ..... B41J 2/01; B41J 2/175; B41J 2/295; B41J 2/20; B41J 2/17566; B41J 2/17596
See application file for complete search history.

(56) References Cited

U.S. PATENT DOCUMENTS 7,417,074 B2 * 8/2008 Hiroki ..... C09D 11/30 106/31.13
2017/0015855 A1 * 1/2017 Sakamoto ..... B41J 2/01
2017/0050447 A1 * 2/2017 Zengo ..... B41J 2/01

FOREIGN PATENT DOCUMENTS

JP 2004-195852 7/2004
JP 2011-073455 4/2011

OTHER PUBLICATIONS

Abstract and machine translation of JP 2004-195852.
Abstract and machine translation of JP 2011-073455.

* cited by examiner

*Primary Examiner* — Huan Tran
(74) *Attorney, Agent, or Firm* — Fildes & Outland, P.C.

(57) ABSTRACT

A liquid supply device includes a first storage unit that stores a first liquid, a second storage unit that stores a second liquid separately from the first liquid, the second liquid containing an infrared absorbing agent, a mixing unit that mixes the first liquid and the second liquid to generate a mixture, and a supply unit that supplies the mixture to an outside of the liquid supply device.

17 Claims, 9 Drawing Sheets

LIQUID SUPPLY DEVICE AND DROPLET EJECTING APPARATUS

CROSS-REFERENCE TO RELATED APPLICATIONS

This application is based on and claims priority under 35 USC 119 from Japanese Patent Application No. 2016-025208 filed Feb. 12, 2016.

BACKGROUND

Technical Field

The present invention relates to a liquid supply device and a droplet ejecting apparatus.

SUMMARY

According to an aspect of the invention, a liquid supply device includes a first storage unit that stores a first liquid, a second storage unit that stores a second liquid separately from the first liquid, the second liquid containing an infrared absorbing agent, a mixing unit that mixes the first liquid and the second liquid to generate a mixture, and a supply unit that supplies the mixture to an outside of the liquid supply device.

BRIEF DESCRIPTION OF THE DRAWINGS

Exemplary embodiments of the present invention will be described in detail based on the following figures, wherein.

DETAILED DESCRIPTION

Hereinafter, an example of an exemplary embodiment of the invention will be described in detail with reference to the drawings. In the exemplary embodiment, as an example of a droplet ejecting apparatus of the invention, an inkjet recording apparatus, which ejects an ink droplet and forms an image on a recording medium, is described. A droplet ejecting head is referred to as an "inkjet recording head" or a "recording head". In addition, a liquid supply device is referred to as an "ink supply device".

First Exemplary Embodiment

Inkjet Recording Apparatus

Figure 1:
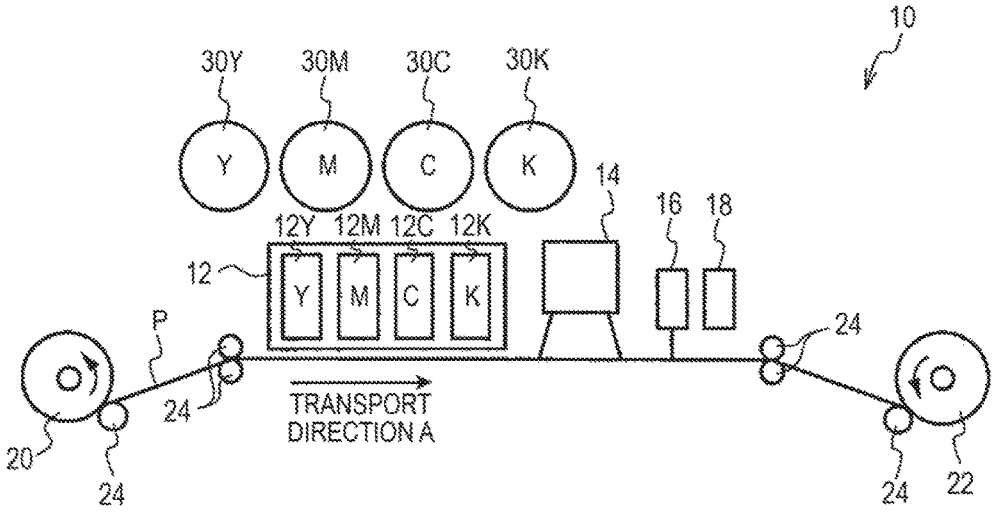
FIG. 1 is a schematic configuration diagram illustrating an example of a configuration of an inkjet recording apparatus according to a first exemplary embodiment of the invention.
Figure 2:
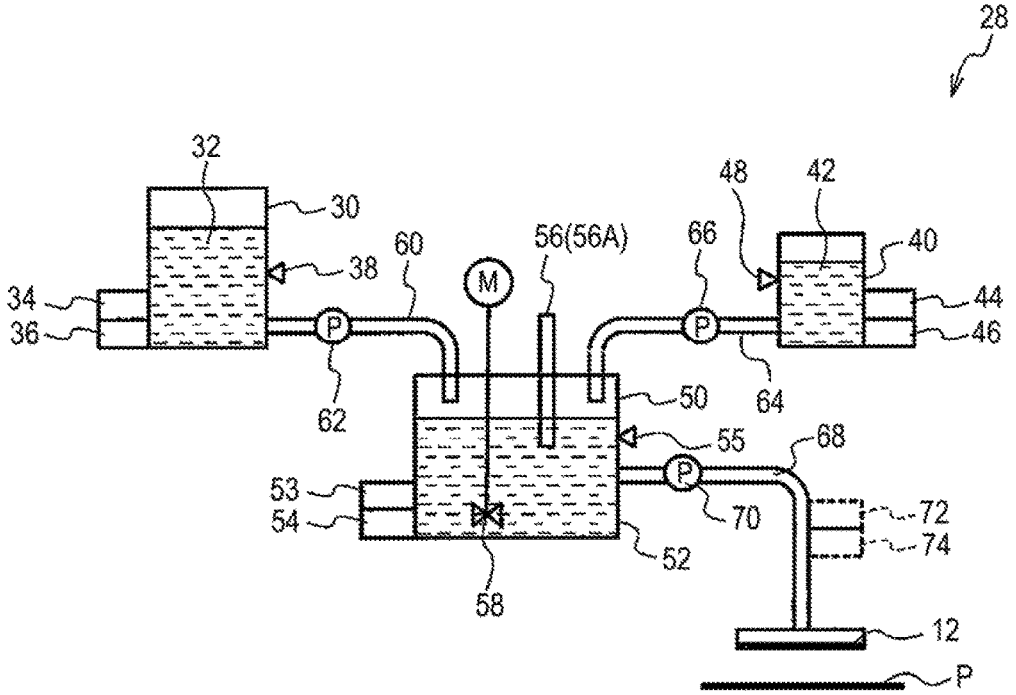
FIG. 2 is a schematic configuration diagram illustrating an example of a configuration of an ink supply device according to the first exemplary embodiment of the invention.
Figure 3:
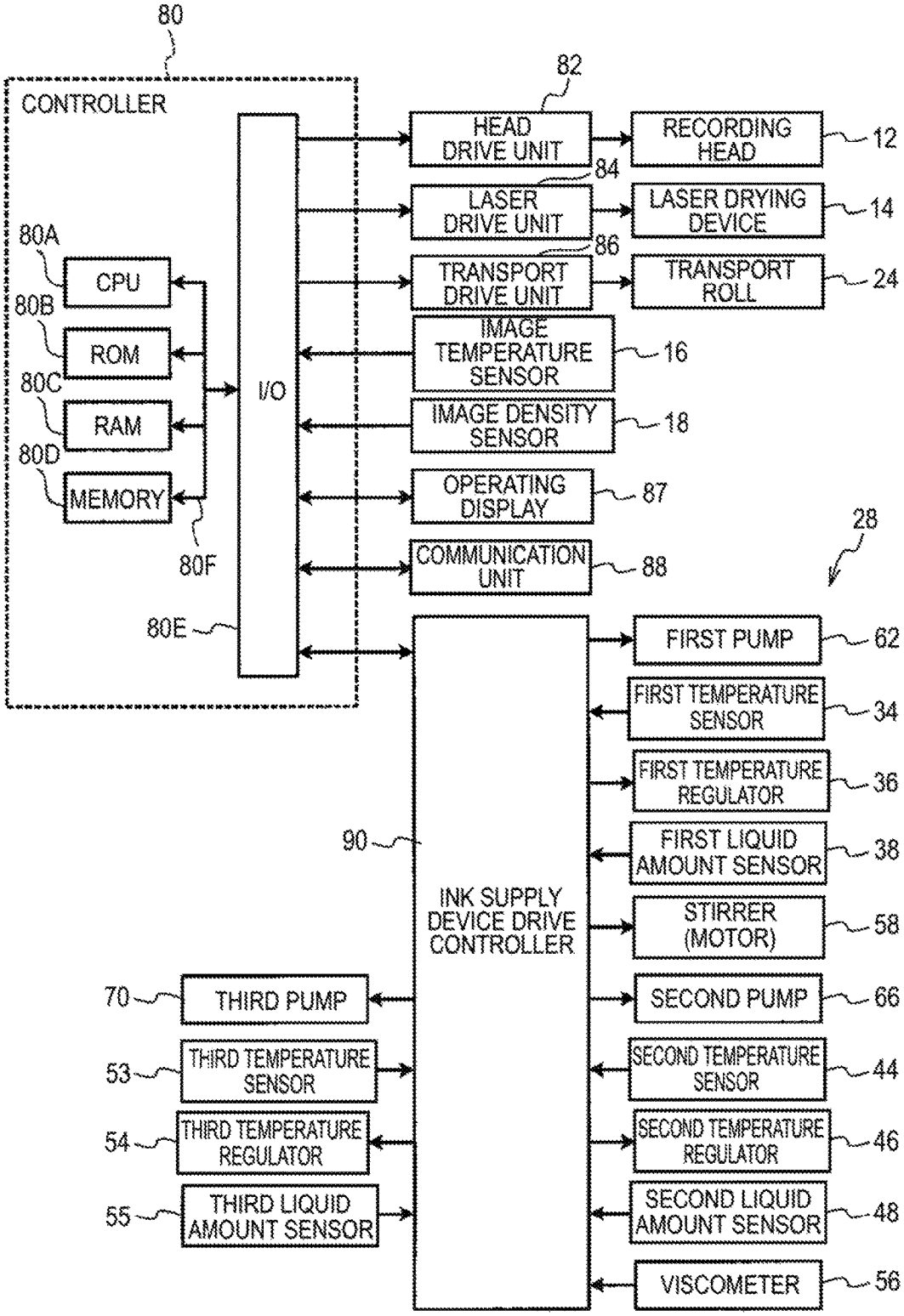
FIG. 3 is a block diagram illustrating an example of an electrical configuration of the inkjet recording apparatus according to the first exemplary embodiment of the invention.

First, an inkjet recording apparatus according to the exemplary embodiment is described. FIG. 1 is a schematic configuration diagram illustrating an example of a configuration of the inkjet recording apparatus according to the first exemplary embodiment of the invention. As illustrated in FIG. 1, an inkjet recording apparatus 10 includes a recording head 12, a laser drying device 14, an image temperature sensor 16, an image density sensor 18, a paper feeding roll 20, a winding roll 22, a transport roll 24, and an ink supply device 28 (only a container 30 illustrated in FIG. 1). Note that the ink supply device 28 is illustrated in FIGS. 2 and 3.

Long continuous paper P as a recording medium is wound around the paper feeding roll 20. The continuous paper P unwound from the paper feeding roll 20 is transported in an arrow A direction in accordance with rotation of the transport roll 24. The continuous paper P transported by the transport roll 24 is finally wound in accordance with rotation of the winding roll 22. Note that, hereinafter, the transport direction of the continuous paper P is simply referred to as a "transport direction". The recording head 12, the laser drying device 14, the image temperature sensor 16, and the image density sensor 18 are all disposed between the paper feeding roll 20 and the winding roll 22 so as to face the continuous paper P. The laser drying device 14 is an example of an "irradiation unit".

In the exemplary embodiment, the recording head 12 includes inkjet recording heads (hereinafter, referred to as the "recording head") 12Y, 12M, 12C, and 12K corresponding to the respective colors of yellow (Y), magenta (M), cyan (C), and black (K). The recording heads 12Y, 12M, 12C, and 12K are disposed in this order as described from the upstream side toward the downstream side in the transport direction. Each of the recording heads 12Y, 12M, 12C, and 12K ejects an ink droplet of a corresponding color from plural nozzles, and forms an image of a corresponding color on the recording medium. The recording heads 12 are driven by a well-known drive method such as a thermal method or a piezoelectric method. In addition, the recording heads are collectively referred to as the "recording head 12" in a case where there is no need to distinguish between the respective colors of YMCK.

The laser drying device 14 is disposed on the downstream side of the recording head 12 in the transport direction. The laser drying device 14 includes plural laser elements, irradiates, with a laser beam from the plural laser elements, the continuous paper P, on which an image is formed by the recording head 12, dries an ink droplet of the image formed on the continuous paper P, and achieves fixing of the image to the continuous paper P.

In the exemplary embodiment, the ink droplets of the respective colors YMCK contain an infrared absorbing agent. When the continuous paper P, on which the image is formed, is irradiated with an infrared laser beam (hereinafter, simply referred to as the "laser beam"), the infrared absorbing agent absorbs the laser beam. In this manner, absorption efficiency of the ink droplet with respect to the laser beam is improved thus, a temperature of the ink droplet is increased, and drying is performed. Here, the "infrared" has a wavelength longer than red light and is light having a long wavelength of 700 nm or longer.

The image temperature sensor 16 is disposed on the downstream side of the laser drying device 14 in the transport direction. The image temperature sensor 16 is a sensor that detects a temperature of an image formed on the continuous paper P. Here, the "temperature of an image" means a temperature of a front surface of the continuous paper P, on which the image is formed, and also means a temperature of an ink droplet ejected to the continuous paper P. As the image temperature sensor 16, it is preferable to use a noncontact temperature sensor, and, for example, a radiation thermometer, which measures intensity of infrared or the like that radiates from an object of a measurement target, and measures a temperature of the object, is used.

The image density sensor 18 is disposed on the downstream side of the image temperature sensor 16 in the transport direction. The image density sensor 18 is an optical reading device for detecting density of an image formed on the continuous paper P. For example, there is used a reflective optical sensor or the like, which includes a light projecting portion and a light receiving portion, receives, by the receiving portion, reflected light of light projected from the light projecting portion, and measures intensity of the reflected light.

In the inkjet recording apparatus described above, the ink droplet is ejected by the recording head 12 and an image is formed on the continuous paper P unwound from the paper feeding roll 20. The continuous paper P, on which the image is formed by the recording head 12, is irradiated with the laser beam by the laser drying device 14, and the ink droplet of the image formed on the continuous paper P is dried. Next, the image temperature sensor 16 detects the temperature of the image formed on the continuous paper P and the image density sensor 18 detects the density of the image formed on the continuous paper P. Finally, the continuous paper P, on which the image is formed and dried, is wound around the winding roll 22 and the image forming on the continuous paper P is completed.

In addition, the inkjet recording apparatus 10 includes a container 30 in which ink is stored. In the exemplary embodiment, the containers 30Y, 30M, 30C, and 30K are provided to correspond to the recording heads 12Y, 12M, 12C, and 12K, respectively. Each of the containers 30Y, 30M, 30C, and 30K stores ink of a corresponding color, and supplies the stored ink to the corresponding recording head 12. In addition, the containers are collectively referred to as the "container 30" in a case where there is no need to distinguish between the respective colors of YMCK. Hereinafter, the container is referred to as a "first container 30" so as to be distinguished from another container.

In the exemplary embodiment, by the ink supply device to be described below, the ink and a dispersion liquid (hereinafter, referred to as an "IR absorbing agent dispersed solution"), in which the infrared absorbing agent is dispersed, are stored in separate containers, respectively. Thus, the ink and the IR absorbing agent dispersed solution are mixed to generate a mixture immediately before being supplied to the recording head 12, and the generated mixture is supplied to the recording head 12. The infrared absorbing agent is poor in storage stability and, particularly, is degraded in the ink. The ink and the IR absorbing agent dispersed solution are stored in separate containers, and thereby degradation of the infrared absorbing agent is reduced, compared to a case where the ink containing the infrared absorbing agent is stored and then is supplied to the recording head 12.

Ink Supply Device

Next, the ink supply device will be described. FIG. 2 is a schematic configuration diagram illustrating an example of a configuration of the ink supply device according to the first exemplary embodiment of the invention. As illustrated in FIG. 2, the ink supply device 28 includes the first container 30 in which ink 32 is stored, a second container 40 in which an IR absorbing agent dispersed solution 42 is stored, and a third container 50 in which the ink and the IR absorbing agent dispersed solution are mixed and a mixture 52 is stored. One end of a supply tube 60 is connected to the first container 30 and the other end is connected to the third container 50. The ink 32 in the first container 30 is supplied to the third container 50 through the supply tube 60. A first pump 62 that regulates a supply amount of the ink 32 is provided in the supply tube 60. The first container 30 is an example of a "first storage unit", and the second container 40 is an example of a "second storage unit". In addition, the third container 50 and a mixing mechanism thereof is an example of a "mixing unit".

In addition, one end of a supply tube 64 is connected to the second container 40 and the other end is connected to the third container 50. The IR absorbing agent dispersed solution 42 in the second container 40 is supplied to the third container 50 through the supply tube 64. A second pump 66 that regulates a supply amount of the IR absorbing agent dispersed solution 42 is provided in the supply tube 64. One end of a supply tube 68 is connected to the third container 50 and the other end is connected to the recording head 12. The mixture 52 in the third container 50 is supplied to the recording head 12 through the supply tube 68. A third pump 70 that regulates a supply amount of the mixture 52 is provided in the supply tube 68. The supply tube 68 is an example of a "supply unit".

The first container 30 that stores the ink 32 is provided with a first temperature sensor 34, a first temperature regulator 36, and a first liquid amount sensor 38. The first temperature sensor 34 detects a temperature of the ink 32 in the first container 30. The first temperature regulator 36 regulates a temperature of the ink 32 in the first container 30. The first liquid amount sensor 38 detects an amount of the ink 32 in the first container 30.

The second container 40 that stores the IR absorbing agent dispersed solution 42 is provided with a second temperature sensor 44, a second temperature regulator 46, and a second liquid amount sensor 48. The second temperature sensor 44 detects a temperature of the IR absorbing agent dispersed solution 42 in the second container 40. The second temperature regulator 46 regulates a temperature of the IR absorbing agent dispersed solution 42 in the second container 40. The second liquid amount sensor 48 detects an amount of the IR absorbing agent dispersed solution 42 in the second container 40.

The third container 50 that stores the mixture 52 is provided with a third temperature sensor 53, a third temperature regulator 54, a third liquid amount sensor 55, a viscometer 56, and a stirrer 58. The third temperature sensor 53 detects a temperature of the mixture 52 in the third container 50. The third temperature regulator 54 regulates a temperature of the mixture 52 in the third container 50. The third liquid amount sensor 55 detects an amount of the mixture 52 in the third container 50. The viscometer 56 measures a viscosity of the mixture 52 in the third container 50. The stirrer 58 is driven to rotate by a motor and stirs the mixture 52 in the third container 50.

The ink supply device 28 includes an ink supply device drive controller 90. The members of the ink supply device 28 are controlled to be driven by the ink supply device drive controller 90 connected to a controller 80 to be described below.

In the ink supply device 28 described above, the temperature of the ink 32 in the first container 30 is regulated to be a room temperature (for example, 25° C.) by the first temperature sensor 34 and the first temperature regulator 36. Meanwhile, the temperature of the IR absorbing agent dispersed solution 42 in the second container 40 is regulated to be a first temperature (for example, 10° C.), at which the infrared absorbing agent is not degraded, by the second temperature sensor 44 and the second temperature regulator 46. In other words, the IR absorbing agent dispersed solution 42 is cooled in order to reduce the degradation during the storage.

Next, the first pump 62 regulates a supply amount through the supply tube 60 and the second pump 66 regulates a supply amount through the supply tube 64. Thus, the ink 32 in the first container 30 and the IR absorbing agent dispersed solution 42 in the second container 40 are supplied to the third container 50 in the regulated supply amount. The ink 32 and the IR absorbing agent dispersed solution 42 are stirred and mixed by the stirrer 58 in the third container 50 and the mixture 52 is generated. The mixing is performed in the third container 50 and thus, there is no need to use a pressure regulating mechanism. When the viscosity of the ink 32 is equal to the viscosity of the IR absorbing agent dispersed solution 42, it is easy to regulate the mixture 52. In a case where the viscosity of the ink 32 is different from the viscosity of the IR absorbing agent dispersed solution 42, the mixture is stirred and mixed, and thereby variations in concentration are reduced.

Next, the temperature of the mixture 52 in the third container 50 is regulated, by the third temperature sensor 53 and the third temperature regulator 54, to a second temperature (for example, 30° C.) at which the mixture 52 has a viscosity (hereinafter, referred to as an "ejection viscosity") suitable for the ejection. In other words, the mixture 52 is heated before being supplied, in order to decrease variations in concentration after the mixing. The viscosity of the mixture 52 is lowered to the ejection viscosity by heating. Thus, the third pump 70 regulates the supply amount through the supply tube 68, and the mixture 52 in the third container 50 is supplied to the recording head 12 in a given supply amount. In the exemplary embodiment, the ejection viscosity may be preferably from 1.5 mPa·s to 30 mPa·s, and more preferably 3 mPa·s to 20 mPa·s. The viscosity may be measured by using Rheomat (manufactured by Contraves) as a measurement apparatus and under the condition of a measurement temperature of 23° C. and a rate of share of 1400 $s^{-1}$.

The supply tube 68 may be further provided with a fourth temperature sensor 72 and a fourth temperature regulator 74, instead of the temperature of the mixture 52 in the third container 50, the temperature of the mixture 52 passing through the supply tube 68 may be regulated, by the fourth temperature sensor 72 and the fourth temperature regulator 74, to the second temperature (for example, 30° C.) at which the mixture 52 has the ejection viscosity. In this case, a line mixer such as a static mixer may be inserted on the downstream side of the fourth temperature regulator 74 and may promote the stirring and the mixing.

Electrical Configuration

Next, an electrical configuration of the inkjet recording apparatus will be described.

FIG. 3 is a block diagram illustrating an example of an electrical configuration of the inkjet recording apparatus according to the first exemplary embodiment of the invention. As illustrated in FIG. 3, the inkjet recording apparatus 10 includes a controller 80 which is a computer. In other words, the controller 80 includes a CPU 80A, a ROM 80B, a RAM 80C, a non-volatile memory 80D, and an input/output interface (I/O) 80E. The CPU 80A, the ROM 80B, the RAM 80C, the memory 80D, and the I/O 80E are connected to one another via a bus 80F. The CPU 80A reads various programs stored in the ROM 80B, and executes the programs using the RAM 80C as the working area.

A head drive unit 82, a laser drive unit 84, a transport drive unit 86, the image temperature sensor 16, the image density sensor 18, an operating display 87, a communication unit 88, and the ink supply device drive controller 90 are connected to the I/O 80E of the controller 80.

The head drive unit 82 drives the recording head 12 in response to control information from the controller 80. In other words, the head drive unit 82 causes the ink droplet to be ejected from the plural nozzles of the recording head 12 in accordance with an ejection amount and an ejection timing of the ink droplet for each of the plural nozzles such that an image is formed on the continuous paper P. The laser drive unit 84 drives the laser drying device 14 in response to the control information from the controller 80. In other words, the laser drive unit 84 irradiates the continuous paper P, on which the image is formed, with laser beams from the plural laser elements of the laser drying device 14 in accordance with intensity of the irradiation and turning on/off timings of each of the plural laser elements. The transport drive unit 86 drives the plural transport rolls 24 to rotate so as to transport the continuous paper P in response to the control information from the controller 80.

Detection results of the image temperature sensor 16 and the image density sensor 18 are output to the controller 80. The operating display 87 has a touch panel display on which a display button or various items of information are displayed, a hardware key such as a numeric keypad or a start button, or the like. With such a configuration described above, the operating display 87 receives an instruction from a user and displays various items of information to the user. The communication unit 88 is a communication interface that is connected to a communications line (not illustrated) and transmits and receives communication data to and from an external device.

The ink supply device drive controller (hereinafter, referred to as a "drive controller") 90 is configured with a computer including a CPU or the like. The drive controller 90 performs drive control of the respective members of the ink supply device 28 in response to the control information from the controller 80. The first pump 62, the first temperature sensor 34, the first temperature regulator 36, the first liquid amount sensor 38, the stirrer 58, the second pump 66, the second temperature sensor 44, the second temperature regulator 46, the second liquid amount sensor 48, the viscometer 56, the third pump 70, the third temperature sensor 53, the third temperature regulator 54, and the third liquid amount sensor 55 are connected to the drive controller 90.

The drive controller 90 drives each of the first pump 62, the second pump 66, and the third pump 70 in accordance with the supply amount set by the controller 80. In addition, the drive controller 90 drives the stirrer 58 in accordance with a stirring speed set by the controller 80. In addition, each of the first temperature sensor 34, the first liquid amount sensor 38, the second temperature sensor 44, the second liquid amount sensor 48, the viscometer 56, the third temperature sensor 53, and the third liquid amount sensor 55 outputs a detection result or a measurement result to the drive controller 90 and the controller 80.

Here, feedback control for adjusting the temperature of the ink or the like to a set temperature is executed by the drive controller 90. The drive controller 90 acquires a detection temperature from the first temperature sensor 34 and performs drive control of the first temperature regulator 36 such that the detection temperature of the first temperature sensor 34 is adjusted to the set temperature, in accordance with the temperature set by the controller 80. Similarly, the drive controller 90 performs drive control of the second temperature regulator 46 such that the detection temperature of the second temperature sensor 44 is adjusted to the set temperature. Similarly, the drive controller 90 performs drive control of the third temperature regulator 54 such that the detection temperature of the third temperature sensor 53 is adjusted to the set temperature.

Concentration Adjusting Process of Infrared Absorbing Agent

Next, a "concentration adjusting process of infrared absorbing agent" will be described. Here, the "infrared absorbing agent concentration" is a concentration of the infrared absorbing agent in the mixture before or after the mixture is ejected from the recording head. For example, the "infrared absorbing agent concentration" is the concentration of the infrared absorbing agent in an ink droplet of the mixture ejected on the recording medium from the recording head or the concentration of the infrared absorbing agent in the mixture stored in the container. In the exemplary embodiment, an image is formed using the ink droplet of the mixture containing the infrared absorbing agent, and thereby absorption efficiency of the laser beam is improved when irradiation is performed with the laser beam so as to perform drying.

As described above, in the exemplary embodiment, the ink and the IR absorbing agent dispersed solution are stored in the separate containers, the ink and the IR absorbing agent dispersed solution are mixed immediately before the supply to the recording head is performed so as to generate the mixture, and thereby the degradation of the infrared absorbing agent. However, after the mixture is generated, it is difficult to reduce the degradation of the infrared absorbing agent. When the infrared absorbing agent is degraded, the absorption efficiency of the laser beam is lowered and then, the ink droplet is insufficiently dried. Therefore, there is a concern that the ink will be rubbed (smudge) on the recording medium, or the ink will be attached (offset) on another recording medium or the like. Therefore, through the "concentration adjusting process of infrared absorbing agent", the concentration of the infrared absorbing agent in the mixture is adjusted before or after the mixture is ejected from the recording head.

Figure 4:
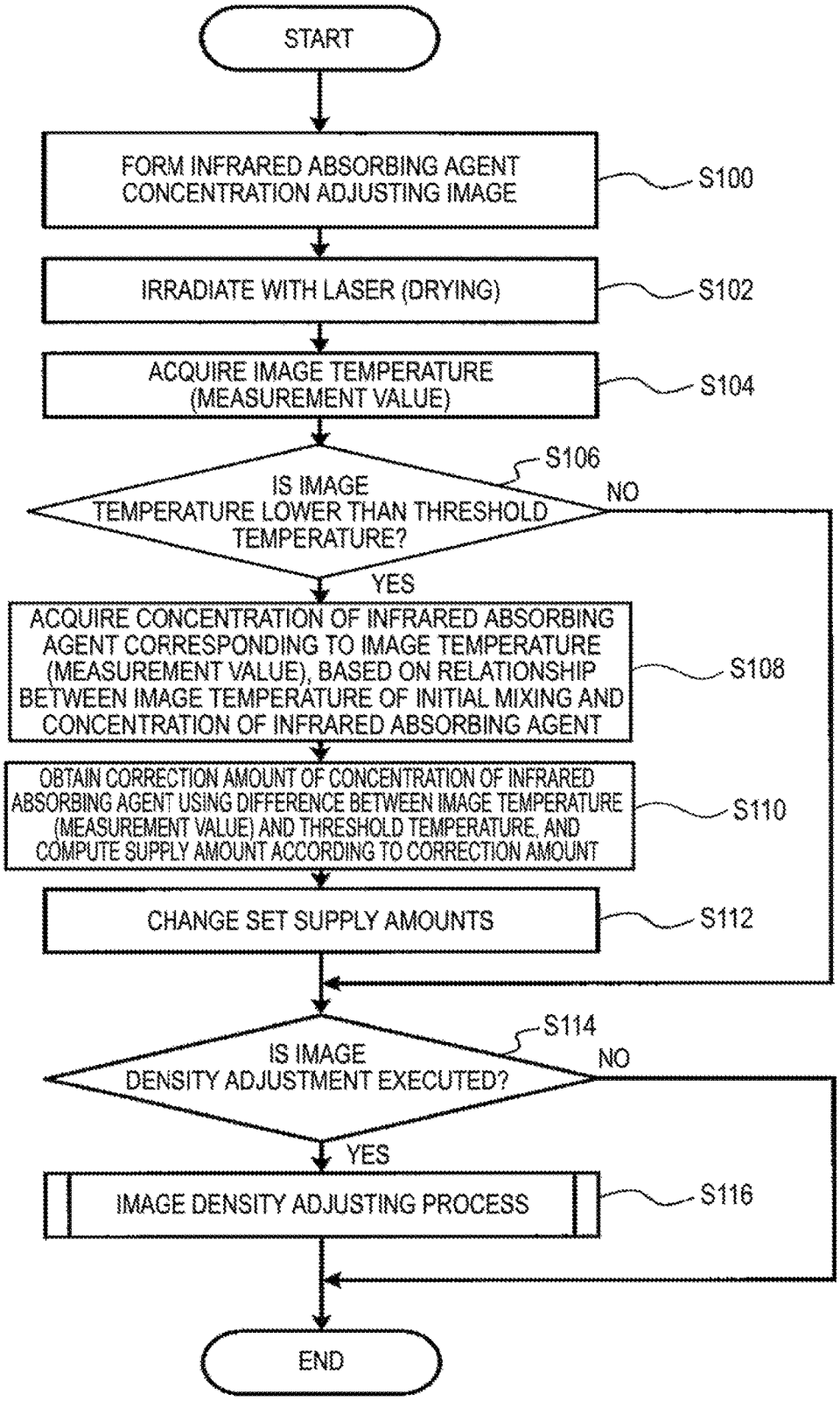
FIG. 4 is a flowchart illustrating an example of a processing procedure of a "concentration adjusting process of infrared absorbing agent" that is executed in the first exemplary embodiment of the invention.

FIG. 4 is a flowchart illustrating an example of a processing procedure of the "concentration adjusting process of infrared absorbing agent" that is executed in the first exemplary embodiment of the invention. The "concentration adjusting process of infrared absorbing agent" is executed by the CPU 80A of the controller 80, when the inkjet recording apparatus 10 is started or inspected, or between operations of image forming. In the exemplary embodiment, the "concentration adjusting process of infrared absorbing agent" is started in response to an execution instruction from a user via the operating display 87. In a case where the "image density adjusting process" is performed, the execution of the "image density adjusting process" is instructed together by the user.

First, in Step S100, the recording head 12 is driven via the head drive unit 82 based on image information of an infrared absorbing agent concentration adjusting image (hereinafter, referred to as the "adjusting image 1") to form an adjusting image 1 on the continuous paper P. Next, in Step S102, the laser drying device 14 is driven via the laser drive unit 84 to irradiate with the laser beam the continuous paper P on which the adjusting image 1 is formed and to dry the ink droplet of the image formed on the continuous paper P.

Next, Step S104, an image temperature measured by the image temperature sensor 16 is acquired. Here, the "concentration of infrared absorbing agent" means the concentration of the infrared absorbing agent in the ink droplet of the mixture ejected onto the continuous paper P from the recording head 12. As the concentration of the infrared absorbing agent in the mixture is higher, absorption efficiency of the laser beam is increased and the image temperature rises.

Next, in Step S106, it is determined whether or not the image temperature acquired in Step S104 is lower than a given threshold temperature. A relationship between an image temperature in initial mixing and the concentration of the infrared absorbing agent is acquired in advance, and an image temperature acquired in a case where the concentration of the infrared absorbing agent in a stage of the initial mixing becomes a target value is set as a threshold temperature (target temperature). In a case where the measured image temperature is lower than the threshold temperature, the process proceeds to Step S108. In a case where the measured image temperature is equal to or higher than the threshold temperature, the process proceeds to Step S114.

The target value of the concentration of the infrared absorbing agent may be set according to a type, a moisture content, reflectivity, glossiness, or the like, of the recording medium. In the case of continuous paper, the target value may be changed during unwinding or after winding is completed. In addition, the target value of the concentration of the infrared absorbing agent may be set according to, for example, types of ink such as a white ink, a spot color ink, a general-purpose in.

In Step S108, the concentration of the infrared absorbing agent in the mixture corresponding to the measured image temperature is acquired, based on the relationship between the image temperature in the initial mixing and the concentration of the infrared absorbing agent. In the case where the image temperature is lower than the threshold temperature, a supply amount of the IR absorbing agent dispersed solution needs to be increased because the concentration of the infrared absorbing agent is low and insufficient. Therefore, in the next Step S110, a correction amount of concentration of the infrared absorbing agent in the mixture is obtained using a difference between the measured image temperature and the threshold temperature, and a supply amount of the ink and a supply amount of the IR absorbing agent dispersed solution are computed according to the obtained amount of correction. In an accurate computation, an amount of the mixture in the third container 50 detected by the third liquid amount sensor 55, a set supply amount of the third pump 70, and the like are included in the computation. In the exemplary embodiment, the supply amount of the ink is not changed, and the supply amount of the IR absorbing agent dispersed solution is increased.

Figure 9A:
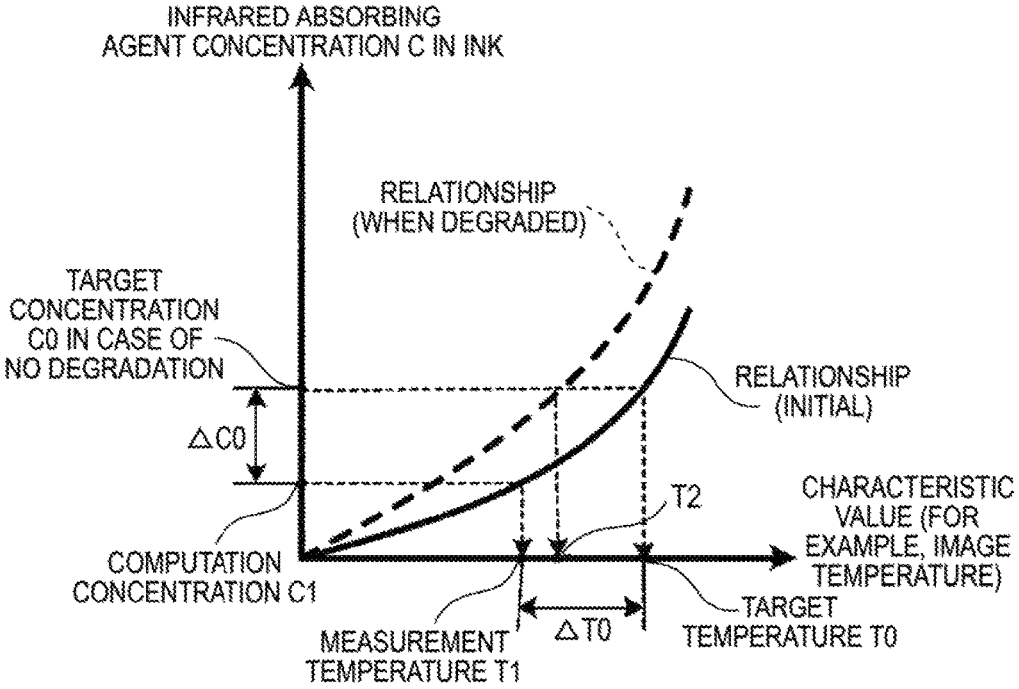
FIGS. 9A and 9B are graphs for depicting a method of adjusting a concentration of an infrared absorbing agent in a mixture.
Figure 9B:
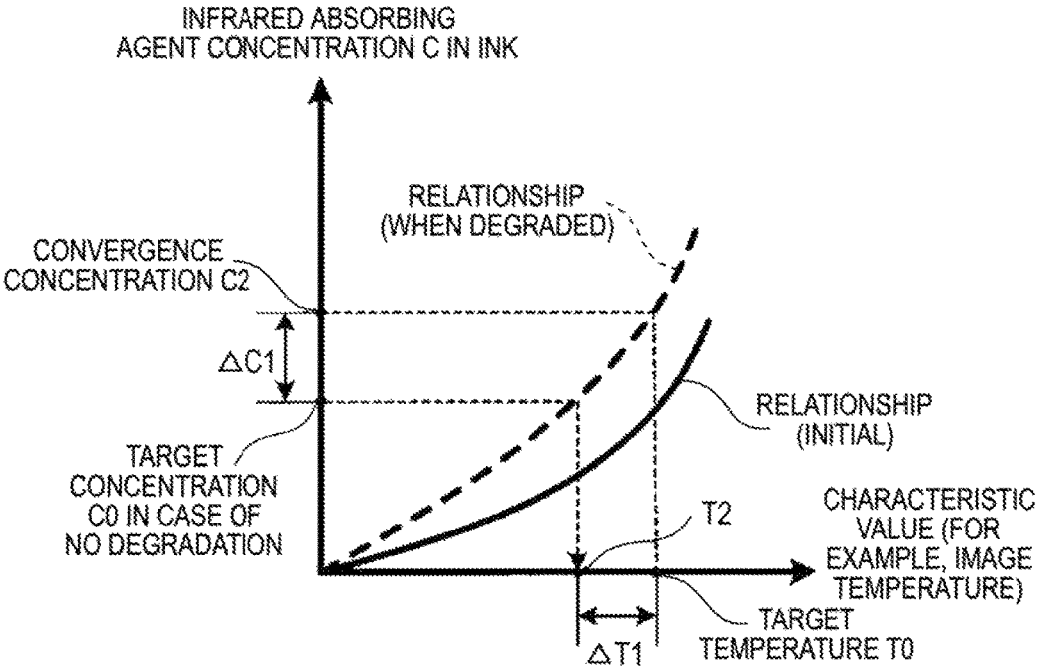

FIGS. 9A and 9B are graphs for depicting a method of adjusting the concentration of the infrared absorbing agent in the mixture. A solid line indicates a "relationship between the image temperature and the concentration of the infrared absorbing agent" in the initial mixing, and a dotted line indicates the "relationship between the image temperature and the concentration of the infrared absorbing agent" obtained after the infrared absorbing agent is degraded. As shown in FIG. 9A, as found from the relationship in the initial mixing, a target temperature $T_0$ of the image temperature is set such that the concentration of the infrared absorbing agent becomes a concentration $C_0$. In addition, as shown in the dotted line in the figures, when the infrared absorbing agent is degraded, the ink properties are degraded, and the "relationship between the image temperature and the concentration of the infrared absorbing agent" is changed. Therefore, even when the concentration of the infrared absorbing agent is the target concentration $C_0$, the image temperature does not reach the target temperature $T_0$ in some cases.

In this case, as shown in FIG. 9B, the concentration $C_2$ (convergence concentration) of the infrared absorbing agent, with which the image temperature becomes a target temperature $T_0$ is obtained from a relationship obtained after an assumed degradation. In this example, it is described that the convergence concentration $C_2$ is obtained at once from the relationship after the assumed degradation; however, it is difficult to estimate a relationship accurately after the degradation. In practice, when a correction amount $\Delta T$ of the image temperature and a correction amount $\Delta C$ of the concentration of the infrared absorbing agent have a substantially proportional relationship, and the feedback control (correction) is repeated such that the correction amount $\Delta T$ of the image temperature approximates to zero, correction amount $\Delta C$ of the concentration of the infrared absorbing agent approximates to zero and the concentration of the infrared absorbing agent converges to the convergence concentration $C_2$.

As shown in FIG. 9A, the correction amount $\Delta T_0$ of the image temperature (=target temperature $T_0$−measured temperature $T_1$) and correction amount $\Delta C_0$ of the concentration of the infrared absorbing agent (=target concentration $C_0$−computation concentration $C_1$) are acquired from the relationship in the initial mixing. As shown in FIG. 9B, in a case where the concentration of the infrared absorbing agent is the target concentration $C_0$ and the measured temperature $T_2$ (<target temperature $T_0$) by the correction based on the relationship in the initial mixing, the correction amount of the image temperature is $\Delta T_1$ (=target temperature $T_0$−measured temperature $T_2$). The correction amount $\Delta C_1$ ($=\Delta C_0(\Delta T_1/\Delta T_0)$) of the concentration of the infrared absorbing agent is obtained from the proportional relationship between $\Delta T$ and $\Delta C$.

The correction amount $\Delta C_1$ is a deviation amount from the target concentration $C_0$, and a new target concentration of the concentration of the infrared absorbing agent is $(C_0+\Delta C_1)$. In the next correction, in a case where the concentration of the infrared absorbing agent is the new target concentration $(C_0+\Delta C_1)$, and the measured temperature $T_z$(<target temperature $T_0$), the correction amount of the image temperature is $\Delta T_2$ (=target temperature $T_0$−measured temperature $T_3$). The correction amount $\Delta C_2$ ($=\Delta C_1\times(\Delta T_2/\Delta T_1)$) of the concentration of the infrared absorbing agent is obtained from the proportional relationship between $\Delta T$ and $\Delta C$. When this is repeated, the image temperature converges on the target temperature $T_0$ and the concentration of the infrared absorbing agent converges on the convergence concentration $C_2$.

Next, in Step S112, the set supply amounts of the first pump 62 and the second pump 66 are changed. Each of the first pump 62 and the second pump 66 is driven in accordance with the set supply amount obtained after the change by the drive controller 90, the concentration of the infrared absorbing agent in the mixture is adjusted, and the image temperature is maintained to have the threshold temperature. Next, in Step S114, it is determined whether or not the "image density adjusting process" is executed. In a case where the "image density adjusting process" is executed, the process proceeds to Step S116, and the "image density adjusting process" is executed and the routine is ended. In a case where the "image density adjusting process" is not executed, the routine is ended.

In the exemplary embodiment, when the image temperature measured by the image temperature sensor 16 is lower than the threshold temperature, the supply amount of the ink and the amount of the IR absorbing agent dispersed solution are reset such that the image temperature is maintained to be equal to or higher than the threshold temperature. In this manner, the concentration of the infrared absorbing agent in the mixture (ink droplet) which is ejected on the continuous paper P from the recording head 12 is regulated.

Image Density Adjusting Process

Figure 5:
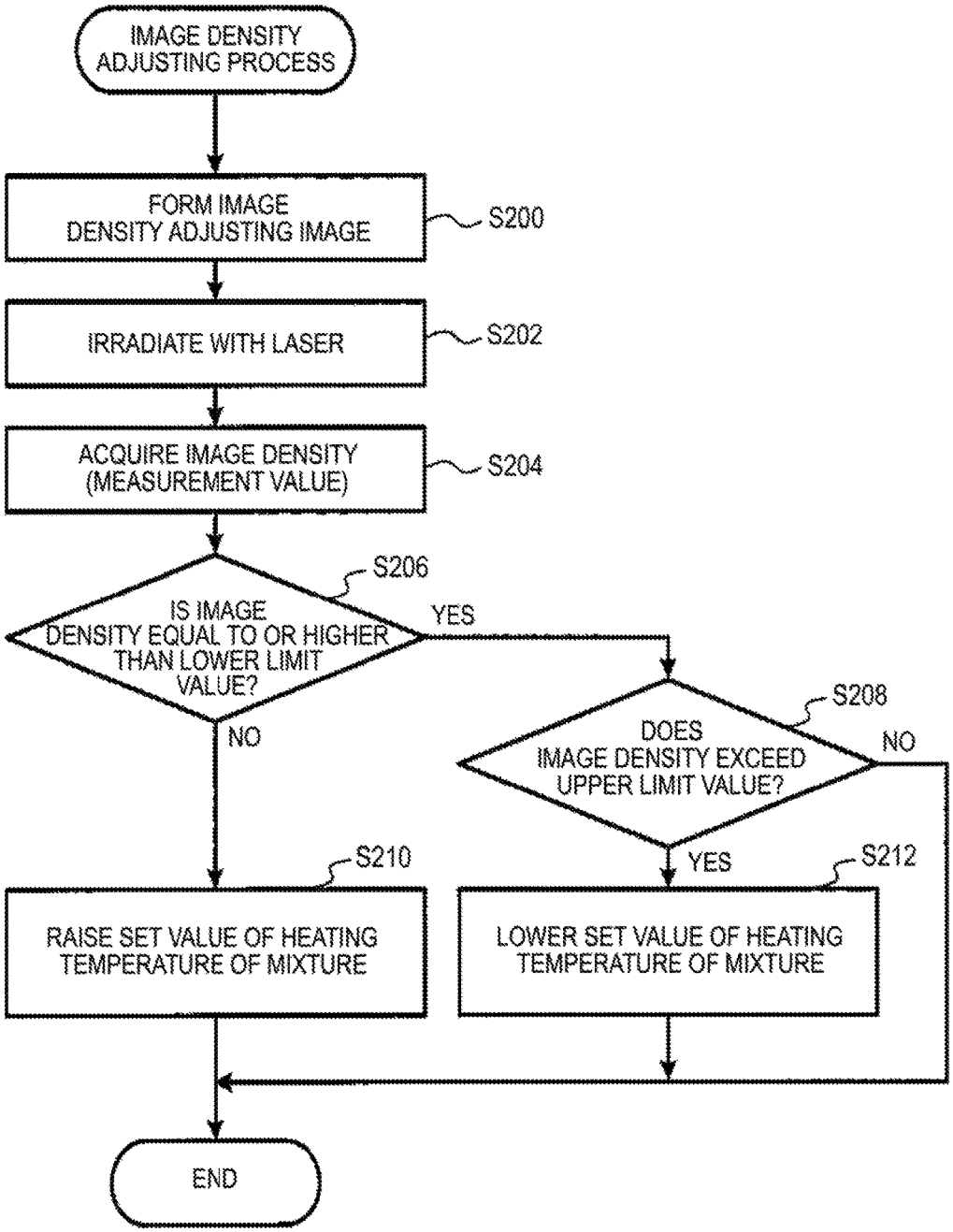
FIG. 5 is a flowchart illustrating an example of a processing procedure of an "image density adjusting process"

Next, the "image density adjusting process" will be described. FIG. 5 is a flowchart illustrating an example of a processing procedure of the "image density adjusting process". First, in Step S200, the recording head 12 is driven via the head drive unit 82 based on the image information of the image density adjusting image (hereinafter, referred to as the "adjusting image 2") to form an adjusting image 2 on the continuous paper P. Next, in Step S202, the laser drying device 14 is driven via the laser drive unit 84 to irradiate with laser beam the continuous paper P on which the adjusting image 2 is formed and to dry the ink droplet of the image formed on the continuous paper P.

Next, in Step S204, the image density measured by the image density sensor 18 is obtained. The adjusting image 2 is formed so as to be the target concentration; however, the ejection amount is reduced as the viscosity of the mixture is increased, and the target concentration is not achieved in some cases, due to a decrease or the like in pigment concentration, by addition of the infrared absorbing agent. Therefore, the lower limit value and the upper limit value of the image density are set with the target density as a reference, the permissible range is from the lower limit value to the upper limit value, and the image density is not adjusted when the density is in the permissible range.

Thus, in Step S206, it is determined that the measured image density is equal to or higher than the lower limit value. In a case where the image density is equal to or higher than the lower limit value, the process proceeds to Step S208, and in step S208, it is determined whether or not the measured image density exceeds the upper limit value. In Step S206, in a case where the measured image density is lower than the lower limit value, the process proceeds to Step S210. In Step S210, the set temperature (set value of a heating temperature) of the third temperature regulator 54, which regulates the temperature of the mixture, is raised, and the routine is ended.

In addition, in Step S208, in a case where the measured image density exceeds the upper limit value, the process proceeds to Step S212. In Step S212, the set temperature (set value of a heating temperature) of the third temperature regulator 54, which regulates the temperature of the mixture, is lowered, and the routine is ended. In Step S208, in a case where the measured image density is equal to or lower than the upper limit value, there is no need to adjust the image density, and thus the routine is ended as is. In the exemplary embodiment, for example, the adjusting image 2 containing patch images of the respective colors YMCK is formed on the continuous paper P, and the image density is adjusted for each color.

As described above, the image density is low with the ink containing the infrared absorbing agent in some cases; however, in the exemplary embodiment, when the image density measured by the image density sensor 18 is out of the permissible range, adjustment of the image density is performed. For example, in a case where the image density is lowered as the viscosity of the mixture is increased, the temperature of the mixture is increased such that the viscosity is lowered. In this manner, the ejection amount of the mixture is increased and thus, the image density is increased. In addition, in a case where the image density is increased as the viscosity of the mixture is lowered, the temperature of the mixture is lowered such that the viscosity is increased. In this manner, the ejection amount of the mixture is decreased and thus, the image density is lowered.

The relationship between the image density and the temperature of the mixture may be obtained in advance, and the temperature (set temperature of the third temperature regulator 54) of the mixture corresponding to the measured image density may be obtained using the relationship.

In addition, the adjusting image 1 and the adjusting image 2 may be the same image. In the case where the adjusting image 1 is the same as the adjusting image 2, the image forming process and the laser irradiation process are common, and the measurement process of the image temperature and the measurement process of the image density are continually performed. In other words, the "concentration adjusting process of infrared absorbing agent" and the "image density adjusting process" are executed in parallel.

Second Exemplary Embodiment

Figure 6:
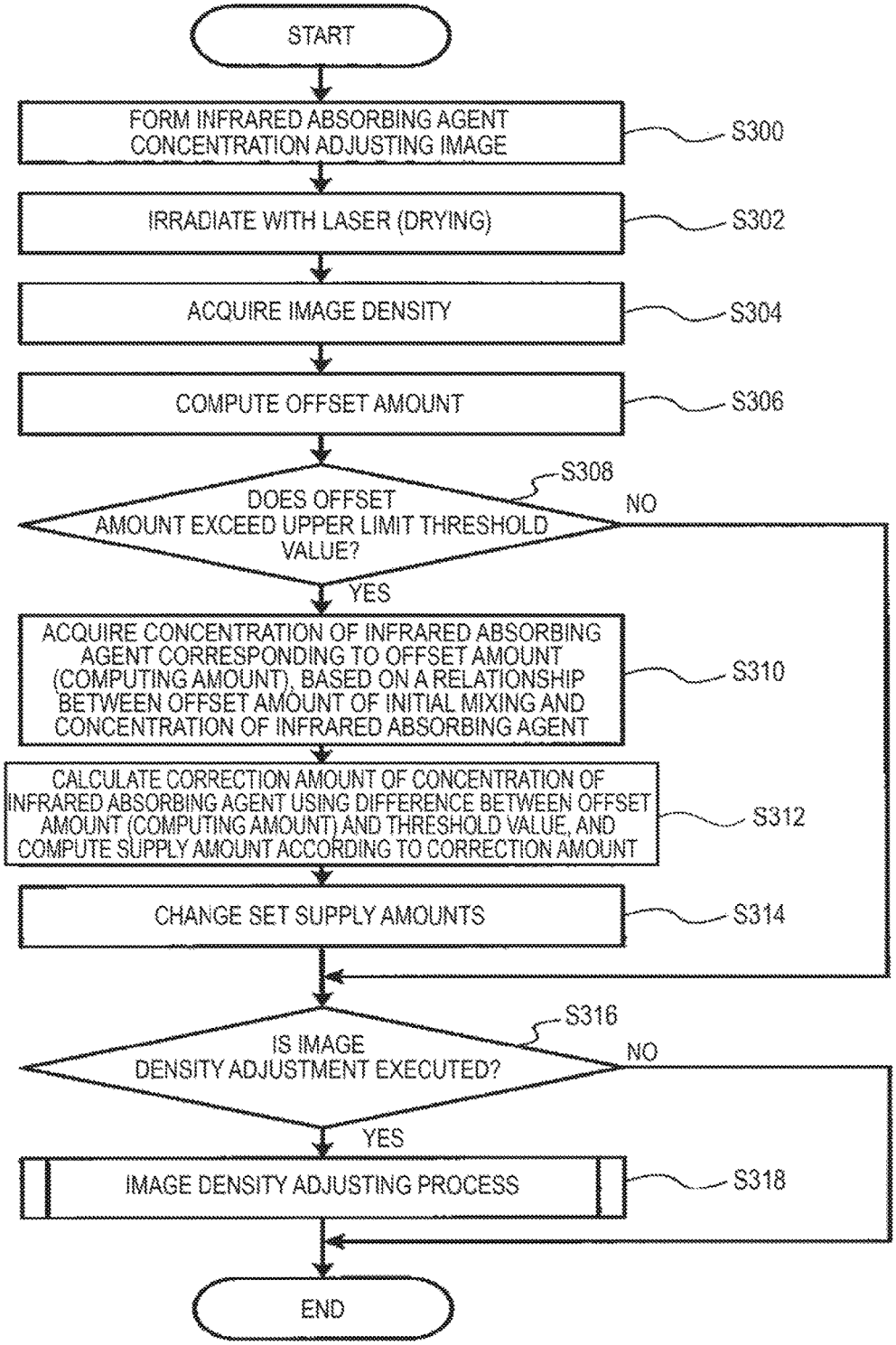
FIG. 6 is a flowchart illustrating an example of a processing procedure of a "concentration adjusting process of infrared absorbing agent" that is executed in a second exemplary embodiment of the invention.

The second exemplary embodiment is the same as the first exemplary embodiment except that, in the "concentration adjusting process of infrared absorbing agent", an "offset amount of an image" is acquired instead of the image temperature. Therefore, description of the exemplary embodiment other than the "concentration adjusting process of infrared absorbing agent" is omitted. FIG. 6 is a flowchart illustrating an example of a processing procedure of the "concentration adjusting process of infrared absorbing agent" that is executed in the second exemplary embodiment of the invention.

First, in Step S300, the recording head 12 is driven via the head drive unit 82 based on image information of the adjusting image 1 to form an adjusting image 1 on the continuous paper P. Next, in Step S302, the laser drying device 14 is driven via the laser drive unit 84 to irradiated with the laser beam the continuous paper P on which the adjusting image 1 is formed and to dry the ink droplet of the image formed on the continuous paper P such that the image is fixed.

Next, in Step S304, after a member is brought into contact with the adjusting image 1 fixed by the irradiation with the laser beam, the adjusting image 1 or the member is read by the image density sensor 18, and an image density is acquired. The member is brought into contact with and rubs the adjusting image 1, and then the adjusting image 1 peels off in a case where the fix level of the ink is low. Hence, the image density of the adjusting image 1 or the member brought into contact with the image is measured, and thereby the fixability of the image is evaluated. The member brought into contact, or pressure, by which contact is performed, needs to be selected such that the fixability can be evaluated; however, it is preferable to have a configuration in which paper wound around a roll is brought into contact with the member at a pressure of 0.01 MPa to 1 MPa, the paper is caused to continuously rotate in a direction opposite to the transport direction of the continuous paper P, and the paper is wound.

Subsequently, in Step S306, an offset amount is computed as an evaluation value representing the fixability of the image, using the read image density. Here, the "offset" occurs in a case where pressure is applied to an image such that the image is rubbed and pulled apart, then the ink image is peeled off from the continuous paper and is transferred to the member brought into contact with the paper, and the fix level of the ink is low. Specifically, in a case where the wound continuous paper P is unwound, the ink image is likely to be transferred to the backside of the continuous paper P, which is brought into contact with the image, and thus the image density is lowered, which results in a problem. The "offset amount" is evaluated quantitatively, and is measured as the image density of the adjusting image 1 after the contact with the member, or the image density of the member brought into contact.

Here, the "concentration of the infrared absorbing agent" is the concentration of the infrared absorbing agent in the ink droplet of the mixture ejected on the continuous paper P from the recording head 12. As the concentration of the infrared absorbing agent in the mixture is decreased, the absorption efficiency of the laser beam is reduced, the drying of the ink droplet is not sufficiently performed, and the offset amount is increased.

Next, in Step S308, it is determined whether or not the offset amount computed in Step S306 exceeds the given upper limit threshold value. A relationship between the offset value of the initial mixing and the concentration of the infrared absorbing agent is acquired in advance, and, in a case where the concentration of the infrared absorbing agent at a stage of the initial mixing is the threshold value (target value), the offset amount is set to the upper limit threshold value. In a case where the computed offset value exceeds the upper limit threshold value, the process proceeds to Step S310. In a case where the computed offset value is equal to or lower than the threshold value, the process proceeds to Step S316.

In Step S310, the concentration of the infrared absorbing agent in the mixture, which corresponds to the computed offset amount, is acquired, based on the relationship between the offset amount of the initial mixing and the concentration of the infrared absorbing agent. In a case where the offset amount exceeds the upper limit threshold value, the concentration of the infrared absorbing agent is decreased and insufficient. Therefore, there is a need to increase the supply amount of the IR absorbing agent dispersed solution. Hence, in Step S312, a correction amount of concentration of the infrared absorbing agent in the mixture is obtained using a difference between the computed offset amount and the upper limit threshold value, and the supply amount of the ink and the supply amount of the IR absorbing agent dispersed solution are computed according to the obtained correction amount.

Next, in Step S314, the set supply amounts of the first pump 62 and the second pump 66 are changed. Since Steps S316 and S318 correspond to Steps S114 and S116 related to the "image density adjusting process" in FIG. 4; description thereof is omitted. When the image density adjusting process is selected by a user, the adjusting of the image density is performed for each of the respective colors of YMCK in a case where the image density is out of the permissible range.

In the exemplary embodiment, when the offset amount computed using the image density read by the image density sensor 18 exceeds the upper limit threshold value, the supply amount of the ink and the supply amount of the IR absorbing agent dispersed solution are reset such that the offset amount is maintained to be equal to or lower than the upper limit threshold value. In this manner, the concentration of the infrared absorbing agent in the mixture (ink droplet) which is ejected on the continuous paper P from the recording head 12 is regulated.

In addition, in the exemplary embodiment, the offset amount is maintained to be equal to or lower than the upper limit threshold value such that a finally formed image has a stable image quality. For example, even when the offset amount is increased and decreased due to the lowering of the laser intensity or the like, the offset amount is reduced with the increase in the concentration of the infrared absorbing agent. In the above description, the offset amount is computed using the image density; however, an evaluation value indicating the fixability of the image may be used. The evaluation value has a correlation with the concentration of the infrared absorbing agent. Instead of the offset amount, image density, blurring, permeation rate, or the like may be computed. Similar to the offset amount, the finally formed image has a stable image quality.

Third Exemplary Embodiment

Figure 7:
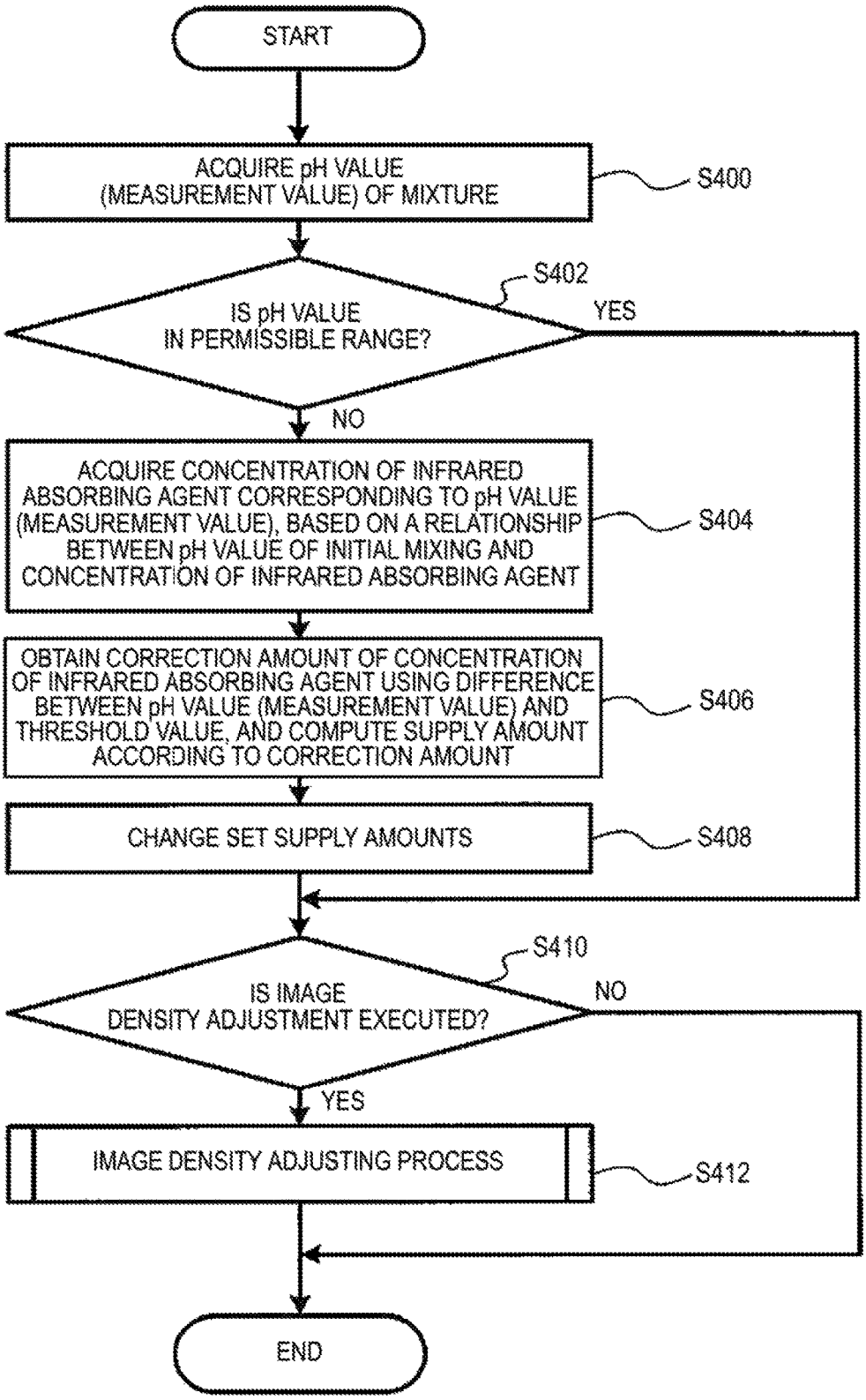
FIG. 7 is a flowchart illustrating an example of a processing procedure of a "concentration adjusting process of infrared absorbing agent" that is executed in a third exemplary embodiment of the invention.

The third exemplary embodiment is the same as the first exemplary embodiment except that, in the "concentration adjusting process of infrared absorbing agent", a "pH value of the mixture" is acquired instead of the image temperature, and the concentration of the infrared absorbing agent in the mixture stored in the third container 50 is adjusted. Therefore, description of the exemplary embodiment other than the "concentration adjusting process of infrared absorbing agent" is omitted. In the third exemplary embodiment, the viscometer 56 illustrated in FIG. 2 functions as a "pH meter 56A". FIG. 7 is a flowchart illustrating an example of a processing procedure of the "concentration adjusting process of infrared absorbing agent" that is executed in a third exemplary embodiment of the invention.

First, in Step S400, a pH value measured by the pH meter 56A is acquired. Next, in Step S402, it is determined whether or not the pH value acquired in Step S400 is in the permissible range. Since there are both of a case where the pH value is increased according to the degradation of the infrared absorbing agent, and a case where the pH value is decreased according to the degradation of the infrared absorbing agent, the permissible range (upper limit threshold value and lower limit threshold value) is set with the pH1 value as a reference value obtained in a case where the concentration of the infrared absorbing agent becomes the threshold value (target value) at a stage of initial mixing, so as to cope with both cases.

In a case where the pH value is out of the permissible range, the process proceeds to Step S404. In a case where the pH value is in the permissible range, the process proceeds to Step S410.

In Step S404, a relationship between the pH value in the initial mixing and the concentration of the infrared absorbing agent is acquired in advance, and the concentration of the infrared absorbing agent in the mixture, which corresponds to the measured pH value, is acquired based on the relationship between the pH value in the initial mixing and the concentration of the infrared absorbing agent. In the case where the pH value is out of the permissible range, the concentration of the infrared absorbing agent is low and insufficient, and thus, there is a need to increase the supply amount of the IR absorbing agent dispersed solution. In Step S406, in a case where the pH value is lower than the lower limit threshold value, a correction amount of concentration of the infrared absorbing agent in the mixture is obtained, using a difference between the measured pH value and the lower limit threshold value. In a case where the pH value is higher than the upper limit threshold value, a correction amount of the concentration of the infrared absorbing agent in the mixture is obtained, using a difference between the measured pH value and the upper limit threshold value. Then, the supply amount of the ink and the supply amount of the IR absorbing agent dispersed solution is computed according to the obtained correction amount.

Next, in Step S408, the set supply amounts of the first pump 62 and the second pump 66 are changed. Since Steps S410 and S412 correspond to Steps S114 and S116 related to the "image density adjusting process" in FIG. 4; description thereof is omitted. When the image density adjusting process is selected by a user, the adjusting of the image density is performed for each of the respective colors of YMCK in a case where the image density is out of the permissible range.

In the exemplary embodiment, when the pH value measured by the pH meter 56A is out of the permissible range, the supply amount of the ink and the supply amount of the IR absorbing agent dispersed solution are reset such that the pH value is maintained to be in the permissible range. Thus, the concentration of the infrared absorbing agent in the mixture (ink droplet), which is stored in the third container 50, is adjusted.

In addition, in the exemplary embodiment, it is easy to perform feedback that measures a physical property of the mixture. For example, instead of the pH value, conductivity, near-infrared absorbance may be measured. In this case, the viscometer 56 illustrated in FIG. 2 functions as a "conductivity meter, or a "near-infrared absorption spectrometer". In addition, in a case where the near-infrared absorbance is measured, in order to eliminate noise, computation is performed with measurement with an absorption peak wavelength of the infrared absorbing agent, and a ratio of the absorbance in a visual light range.

Fourth Exemplary Embodiment

Figure 8:
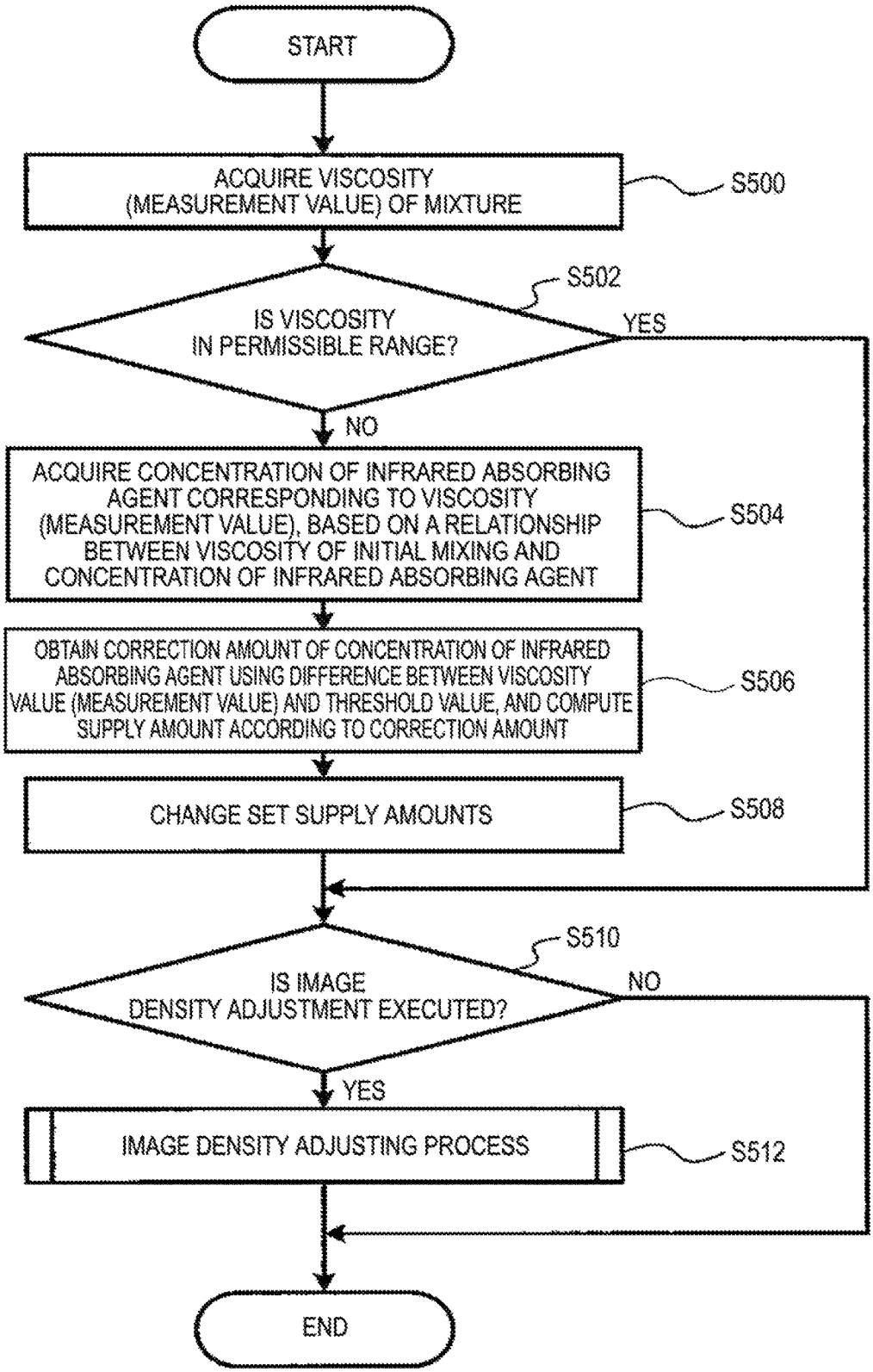
FIG. 8 is a flowchart illustrating an example of a processing procedure of a "concentration adjusting process of infrared absorbing agent" that is executed in a fourth exemplary embodiment of the invention.

The fourth exemplary embodiment is the same as the first exemplary embodiment except that, in the "concentration adjusting process of infrared absorbing agent", "viscosity of the mixture" is acquired instead of the image temperature, and the concentration of the infrared absorbing agent in the mixture stored in the third container 50 is adjusted. Therefore, description of the exemplary embodiment other than the "concentration adjusting process of infrared absorbing agent" is omitted. FIG. 8 is a flowchart illustrating an example of a processing procedure of the "concentration adjusting process of infrared absorbing agent" that is executed in the fourth exemplary embodiment of the invention.

First, in Step S500, the viscosity measured by the viscometer 56 is acquired. The temperature of the mixture stored in the third container 50 is regulated, by the third temperature sensor 53 and the third temperature regulator 54, to a second temperature (for example, 30° C.) at which the mixture has the ejection viscosity. In other words, the viscosity of the mixture is regulated to be the ejection viscosity. However, the viscosity of the mixture is increased according to the degradation of the infrared absorbing agent.

Next, in Step S502, it is determined whether or not the viscosity acquired in Step S500 is in the permissible range. Since there are both of a case where the viscosity is increased according to the degradation of the infrared absorbing agent, and a case where the viscosity is decreased according to the degradation of the infrared absorbing agent, the permissible range (upper limit threshold value and lower limit threshold value) is set with the viscosity as a reference value obtained in a case where the concentration of the infrared absorbing agent becomes the threshold value (target value), so as to cope with both cases.

In a case where the viscosity is out of the permissible range, the process proceeds to Step S504. In a case where the viscosity is in the permissible range, the process proceeds to Step S510.

In Step S504, a relationship between the viscosity in the initial mixing and the concentration of the infrared absorbing agent is acquired in advance, and the concentration of the infrared absorbing agent in the mixture, which corresponds to the measured viscosity, is acquired based on the relationship between the viscosity in the initial mixing and the concentration of the infrared absorbing agent. In the case where the viscosity is out of the permissible range, the concentration of the infrared absorbing agent is low and insufficient, and thus, there is a need to increase the supply amount of the IR absorbing agent dispersed solution. In Step S506, in a case where the viscosity is lower than the lower limit threshold value, a correction amount of concentration of the infrared absorbing agent in the mixture is obtained, using a difference between the measured viscosity and the lower limit threshold value. In a case where the viscosity is higher than the upper limit threshold value, a correction amount of concentration of the infrared absorbing agent in the mixture is obtained using a difference between the measured viscosity and the upper limit threshold value. Then, the supply amount of the ink and the supply amount of the IR absorbing agent dispersed solution is computed according to the obtained correction amount.

Next, in Step S508, the set supply amounts of the first pump 62 and the second pump 66 are changed and the routine is ended. Although not illustrated, the "image density adjusting process" may be executed even in the exemplary embodiment.

In the exemplary embodiment, when the viscosity measured by the viscometer 56 is out of the permissible range, the supply amount of the ink and the supply amount of the IR absorbing agent dispersed solution are reset such that the viscosity is maintained to be in the permissible range. Thus, the concentration of the infrared absorbing agent in the mixture (ink droplet), which is stored in the third container 50, is adjusted.

Modification Example

The configuration of the liquid supply device and the droplet ejecting apparatus described in the exemplary embodiments described above is an example, and it is needless to say that the configuration may be modified within a range without departing from the gist of the invention.

In the exemplary embodiment described above, as an example of the droplet ejecting apparatus, an inkjet recording apparatus is described; however, the droplet ejecting apparatus is not limited to the inkjet recording apparatus. Examples of the droplet ejecting apparatus may include a color-filter manufacturing apparatus that ejects ink or the like on a film or glass and manufactures a color filter, an apparatus that ejects an organic EL solution on a substrate and forms an EL display panel, an apparatus that ejects solder in a dissolved state and forms a component mounting bump, an apparatus that ejects a liquid containing metal and forms a wiring pattern, various film-forming apparatuses that eject a droplet and form a film, and an apparatus that ejects a droplet.

In addition, the ink supply device is described as an example of the liquid supply device; however, the liquid supply device is not limited to the ink supply device. The liquid supply device may be widely utilized for a use in which there is a concern that, when the first liquid and the second liquid containing the infrared absorbing agent are mixed, the infrared absorbing agent will be degraded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid supply device comprising:
- a first storage unit that stores a first liquid;
- a second storage unit that stores a second liquid separately from the first liquid, the second liquid containing an infrared absorbing agent;
- a first temperature regulating unit that is provided in the second storage unit and regulates a temperature of the second liquid to a first temperature at which the infrared absorbing agent is not degraded;
- a mixing unit that mixes the first liquid and the second liquid to generate a mixture; and
- a supply unit that supplies the mixture to an outside of the liquid supply device.

2. The liquid supply device according to claim 1, wherein the mixing unit stirs and mixes the first liquid and the second liquid.

3. The liquid supply device according to claim 1, further comprising:
- a second temperature regulating unit that is provided in the supply unit and regulates a temperature of the mixture, which is supplied to the outside, to a second temperature at which the mixture has a viscosity equal to or lower than a threshold value.

4. A liquid supply device comprising:
- a first storage unit that stores a first liquid;
- a second storage unit that stores a second liquid separately from the first liquid, the second liquid containing an infrared absorbing agent;
- a regulation unit that regulates a supply amount of the first liquid and a supply amount of the second liquid;
- a mixing unit that mixes the first liquid and the second liquid in the supply amounts regulated by the regulation unit to generate a mixture;

a supply unit that supplies the mixture to an outside of the liquid supply device;

an acquisition unit that acquires a characteristic value having a correlation with a concentration of the infrared absorbing agent in the mixture before or after the mixture is supplied to the outside; and a controller that controls the regulation unit such that the characteristic value acquired by the acquisition unit is in a permissible range.

5. The liquid supply device according to claim 4, wherein the controller controls the regulation unit such that in a case where the characteristic value acquired by the acquisition unit is out of a permissible range, the controller obtains a correction amount of a concentration of the infrared absorbing agent in the mixture and then increases the supply amount of the second liquid in accordance with the obtained correction amount.

6. The liquid supply device according to claim 4, further comprising:

a first temperature regulating unit that is provided in the second storage unit and regulates a temperature of the second liquid to a first temperature at which the infrared absorbing agent is not degraded.

7. A droplet ejecting apparatus comprising:

a droplet ejecting head that ejects a droplet from a nozzle and forms an image on a recording medium;

a first storage unit that stores a first liquid;

a second storage unit that stores a second liquid separately from the first liquid, the second liquid containing an infrared absorbing agent;

a first temperature regulating unit that is provided in the second storage unit and regulates a temperature of the second liquid to a first temperature at which the infrared absorbing agent is not degraded;

a mixing unit that mixes the first liquid and the second liquid to generate a mixture;

a supply unit that supplies the mixture to the droplet ejecting head; and an irradiation unit that irradiates, with a laser beam, the image formed on the recording medium.

8. The droplet ejecting apparatus according to claim 7, wherein the mixing unit stirs and mixes the first liquid and the second liquid.

9. The droplet ejecting apparatus according to claim 7, further comprising:

a second temperature regulating unit that is provided in the supply unit and that regulates a temperature of the mixture, which is supplied to the droplet ejecting head, to a second temperature at which the mixture has a viscosity suitable for the ejection.

10. A droplet ejecting apparatus comprising:

a droplet ejecting head that ejects a droplet from a nozzle and forms a image on a recording medium;

a first storage unit that stores a first liquid;

a second storage unit that stores a second liquid separately from the first liquid, the second liquid containing an infrared absorbing agent;

a regulation unit that regulates a supply amount of the first liquid and a supply amount of the second liquid;

a mixing unit that mixes the first liquid and the second liquid in the supply amounts regulated by the regulation unit to generate a mixture;

a supply unit that supplies the mixture to the droplet ejecting head;

an irradiation unit that irradiates, with a laser beam, the image formed on the recording medium;

an acquisition unit that acquires a characteristic value having a correlation with a concentration of the infrared absorbing agent in the mixture before or after the mixture is ejected from the droplet ejecting head; and a controller that controls the regulation unit such that the characteristic value acquired by the acquisition unit is in a permissible range.

11. The droplet ejecting apparatus according to claim 10, wherein the controller controls the regulation unit such that in a case where the characteristic value acquired by the acquisition unit is out of a permissible range, the controller obtains an correction amount of concentration of the infrared absorbing agent in the mixture, and then increases a supply amount of the second liquid in accordance with the obtained correction amount.

12. The droplet ejecting apparatus according to claim 11, wherein the acquisition unit acquires, as the characteristic value, a temperature of the image after the image is irradiated with the laser beam by the irradiation unit, and wherein the controller obtains a correction amount of concentration of the infrared absorbing agent in the mixture after the mixture is ejected from the droplet ejecting head, using a difference between the temperature of the image acquired by the acquisition unit and a threshold temperature, based on a relationship between a temperature of the image which is obtained in advance and the concentration of the infrared absorbing agent.

13. The droplet ejecting apparatus according to claim 11, wherein the acquisition unit acquires, as the characteristic value, an evaluation value representing fixability of the image after the image is irradiated with the laser beam by the irradiation unit, and wherein the controller obtains the correction amount of the concentration of the infrared absorbing agent in the mixture after the mixture is ejected from the droplet ejecting head, using a difference between the evaluation value acquired by the acquisition unit and a threshold evaluation value, based on a relationship between an evaluation value which is obtained in advance and the concentration of the infrared absorbing agent.

14. The droplet ejecting apparatus according to claim 11, wherein the acquisition unit acquires, as the characteristic value, a physical value representing a property of the mixture that is supplied to the droplet ejecting head, and wherein the controller obtains the correction amount of the concentration of the infrared absorbing agent in the mixture after the mixture is ejected from the droplet ejecting head, using a difference between the physical value acquired by the acquisition unit and a threshold physical value, based on a relationship between a physical value which is obtained in advance and the concentration of the infrared absorbing agent.

15. The droplet ejecting apparatus according to claim 14, wherein the physical value representing the property of the mixture is any one of pH, a conductivity, a viscosity, or a near-infrared absorbance.

16. The droplet ejecting apparatus according to claim 10, further comprising:

a temperature regulating unit that regulates a temperature of the mixture which is supplied to the droplet ejecting head; and a density detecting unit that detects an image density after the image is irradiated with a laser beam by the irradiation unit, wherein the controller controls the temperature regulating unit such that the image density, which is detected by the density detecting unit, is equal to or higher than a threshold value.

17. The droplet ejecting apparatus according to claim 10, further comprising:

a first temperature regulating unit that is provided in the second storage unit and regulates a temperature of the second liquid to a first temperature at which the infrared absorbing agent is not degraded.

* * * * *